US007511241B1

(12) United States Patent
Magda

(10) Patent No.: US 7,511,241 B1
(45) Date of Patent: Mar. 31, 2009

(54) ROTARY INDEXING MECHANISM FOR A MECHANICALLY ACTIVATED CONTROL

(76) Inventor: Martin A. Magda, 610 Beam St., Salisbury, MD (US) 21801

( * ) Notice: Subject to any disclaimer, the term of this patent is extended or adjusted under 35 U.S.C. 154(b) by 59 days.

(21) Appl. No.: 11/647,807

(22) Filed: Dec. 30, 2006

(51) Int. Cl.
*H01H 13/62* (2006.01)

(52) U.S. Cl. ..... 200/565; 200/336

(58) Field of Classification Search ..... 200/43.08, 200/336, 560–570, 17 R, 14, 11 R
See application file for complete search history.

(56) References Cited

U.S. PATENT DOCUMENTS

| | | | | |
|---|---|---|---|---|
| 2,812,407 | A * | 11/1957 | Budd | 338/171 |
| 3,248,490 | A | 4/1966 | Allison et al. | |
| 3,311,718 | A | 3/1967 | Allison et al. | |
| 4,891,476 | A | 1/1990 | Nation et al. | |
| 5,187,630 | A * | 2/1993 | MacKay et al. | 360/137 |
| 5,606,155 | A | 2/1997 | Garcia | |
| 6,374,696 | B1 * | 4/2002 | Blake et al. | 74/527 |
| 6,384,357 | B1 * | 5/2002 | Morrison | 200/520 |
| 6,610,938 | B2 * | 8/2003 | Funfer | 200/11 R |
| 6,781,070 | B1 | 8/2004 | Holt | |
| 2004/0129552 | A1 * | 7/2004 | Nakade | 200/565 |
| 2007/0235313 | A1 * | 10/2007 | Maguire et al. | 200/565 |

* cited by examiner

*Primary Examiner*—Michael A Friedhofer
*Assistant Examiner*—Lisa N Klaus
(74) *Attorney, Agent, or Firm*—Richard L. Miller

(57) ABSTRACT

A rotary indexing mechanism for a mechanically activated control. The mechanism includes an insulator, an input assembly, and an output assembly. The insulator rotatably attaches to the mechanically activated control by way of a frame of the mechanically activated control. The input assembly is operatively connected to the insulator and selectively rotates the insulator. The output assembly is operatively connected to the insulator and selectively activates the mechanically activated control.

14 Claims, 3 Drawing Sheets

7,8,9
12
18
OUTPUT
INPUT
16
14
10

3
12
19
18
20
16
36
40
4
38
30
36
28
40
10
22
46
48
50
42
52
44
5
40
22
36
38
5
26
30

ROTARY INDEXING MECHANISM FOR A MECHANICALLY ACTIVATED CONTROL

1. BACKGROUND OF THE INVENTION

A. Field of the Invention

The embodiments of the present invention relate to a rotary indexing mechanism, and more particularly, the embodiments of the present invention relate to a rotary indexing mechanism for a mechanically activated control. Typically such controls while not limited to can be selected from the group consisting of electrical switches, fluid vales, fiber optic switches, mechanical mechanism and a host of other mechanically activated controls to numerous to mention.

B. Description of the Prior Art

Numerous innovations for rotary indexing mechanisms have been provided in the prior art, which will be described below in chronological order to show advancement in the art, and which are included herein by reference thereto. Even though these innovations may be suitable for the specific individual purposes to which they address, however, they differ from the embodiments of the present invention in that they do not teach a rotary indexing mechanism for a mechanically activated control.

(1) U.S. Pat. No. 3,248,490 to Allison et al.

U.S. Pat. No. 3,248,490 issued to Allison et al. on Apr. 26, 1966 in class 200 and subclass 14 teaches a multi-position electric switch having a supporting bracket, a pair of tie rods extending from the supporting bracket, at least one stator mounted onto the pair of tie rods, a shaft journaled in a bearing carried by the supporting bracket, and a rotor operatively associated with the stator and constrained to rotate with the shaft whereby upon rotation of the shaft a contact on the stator is selectively engaged by a contact on the rotor. The switch further has a multiple tie rod fastener of resilient material fixedly securing the stator onto the tie rods. The fastener includes a central portion, and pair of end members disposed at an angle to the central portion of the fastener and integral therewith. Each of the angles define a thrust bearing biased against the stator and exerting a force substantially parallel to the axis of the tie rods. Each of the end members are provided with an aperture receiving the tie rods. An end portion surrounding each of the apertures bites into the tir rod associated therewith and defines a fulcrum. The central portion is bowed during assembly of the fastener onto the tie rods thereby pivotally biasing the thrust bearings of the fastener forceably against the stator after the force assembling the fastener onto the tie rods is released.

(2) U.S. Pat. No. 3,311,718 to Allison et al.

U.S. Pat. No. 3,311,718 issued to Allison et al. on Mar. 28, 1967 in class 200 and subclass 11 teaches a switch including a cup-shaped housing defining a chamber open at one end, a contact carrier closing the open end of the chamber, a shaft rotatably mounted in the housing and having one end extending into the chamber, a plurality of circumferentially spaced stationary contacts carried by the contact carrier and extending into the chamber, a stationary center contact carried by the contact carrier, a driver disposed in the chamber and constrained to rotate with the shaft, a tolerance compensator biasing the driver against the contact carrier and the shaft outwardly of the housing, a movable contactor carried by the driver for wiping engagement with the stationary center contact an the circumferentially spaced stationary contacts upon rotation of the shaft, and indexing apparatus for positioning the shaft in a plurality of positions.

(3) U.S. Pat. No. 4,891,476 to Nation et al.

U.S. Pat. No. 4,891,476 issued to Nation et al. on Jan. 2, 1990 in class 200 and subclass 11 R teaches an index rotary switch including a rotary contact carrier journaled between a pair of thrust bearings solely for rotary motion. A rotary electrical contact including four contacts indexes with a stationary contact array forming an infinite number of ON-OFF positions and forms a redundant constant pressure electrical contact in each ON position.

(4) U.S. Pat. No. 5,606,155 to Garcia.

U.S. Pat. No. 5,606,155 issued to Garcia on Feb. 25, 1997 in class 200 and subclass 11 R teaches a rotary switch having a ferrule and a rotor and stator assembly housed within a plastic cylindrically shaped housing. The ends of the housing are folded to hold the ferrule and stator in end positions within the housing on edges located on the interior wall the housing. The rotor has a shaft rotatably mounted in the ferrule for relative movement over the stator. Stationary contacts are on the stator, while moveable ball contacts are carried by the rotor seat on the stator for displacement relative to the stationary contacts upon turning of the rotor via the shaft. A detent mechanism cooperates with the interior wall of the housing to establish detent positions corresponding with predetermined electrical coupling of the stator contacts by the ball contacts.

(5) U.S. Pat. No. 6,781,070 to Holt.

U.S. Pat. No. 6,781,070 issued to Holt on Aug. 24, 2004 in class 200 and subclass 11 R teaches a rotary indexing switch including a base having a series of radially spaced stationary contact areas, and a rotary contact member having a rotary contact area. The stationary contact areas are defined by contact members engaged within passages in an insulating ring in a configuration dictated by specifications of the switch. The switch includes a mating engagement structure drivingly engaging actuator shafts of stacked switch assemblies, a spring for biasing the rotary contact member toward the stationary contact areas, a combination lift and detent arrangement for lifting the rotary contact areas away from the stationary contact areas and maintaining the rotary contact member in a contact position when the rotary contact areas are engaged with the stationary contact areas, a center contact selectively engageable with the base utilizing a cooperating engagement arrangement, and an integral enclosure wall forming a dust shield.

It is apparent that numerous innovations for rotary indexing mechanism have been provided in the prior art that are adapted to be used. Furthermore, even though these innovations may be suitable for the specific individual purposes to which they address, however, they would not be suitable for the purposes of the embodiments of the present invention as heretofore described, namely, a rotary indexing mechanism for a mechanically activated control.

2. SUMMARY OF THE INVENTION

Thus, it is an object of the present invention to provide a rotary indexing mechanism for a mechanically activated control that avoids the disadvantages of the prior art.

Briefly stated, another object of the present invention is to provide a rotary indexing mechanism for a mechanically activated control. The mechanism includes an insulator, an input assembly, and an output assembly. The insulator rotatably attaches to the mechanically activated control by way of a frame of the mechanically activated control. The input assembly is operatively connected to the insulator and selectively rotates the insulator. The output assembly is operatively connected to the insulator and selectively activates the mechanically activated control.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

3. BRIEF DESCRIPTION OF THE DRAWING

The figures of the drawing are briefly described as follows.

Figures 1, 2, 4:
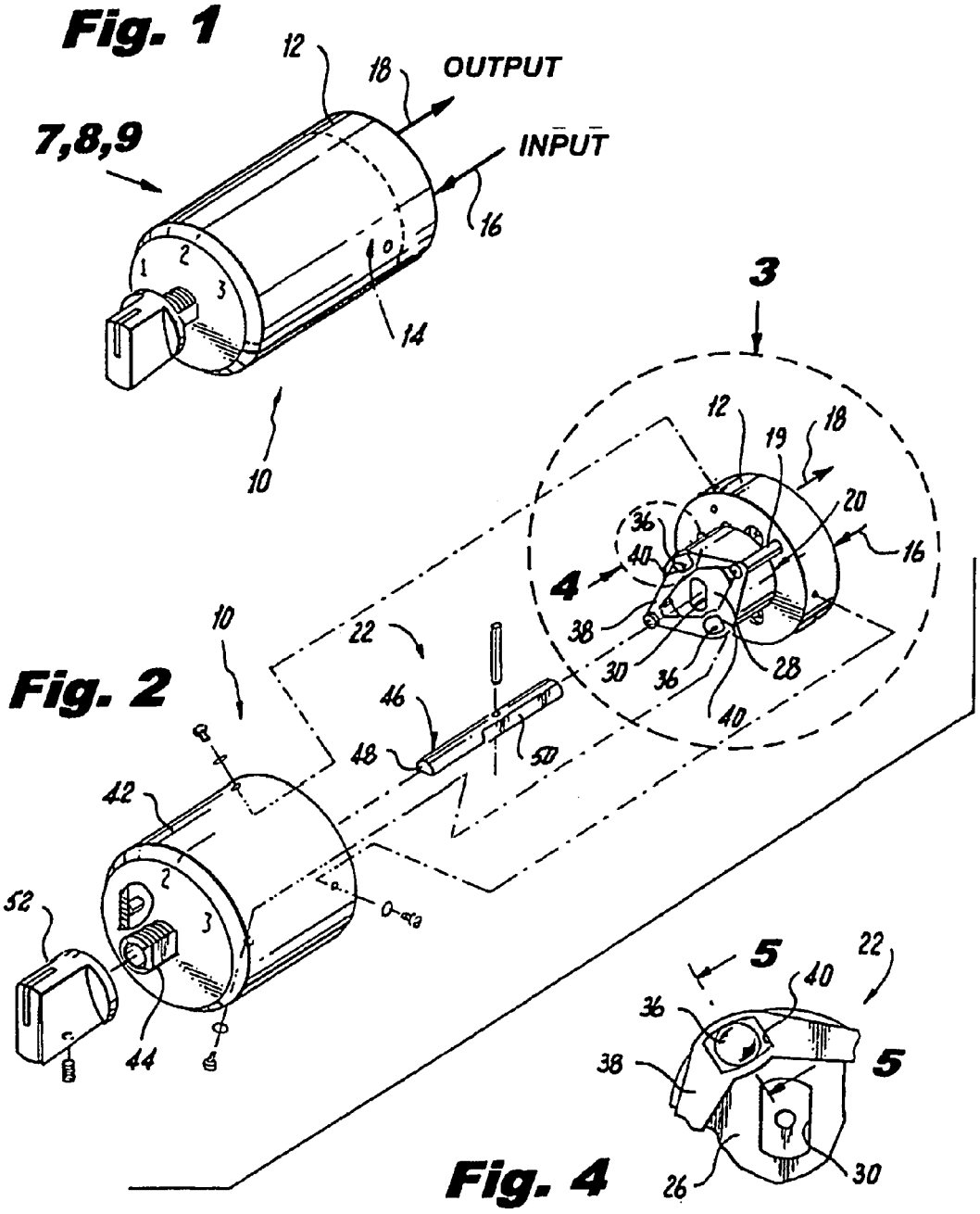
FIG. 1 is a diagrammatic perspective view of the rotary indexing mechanism of the embodiments of the present invention operatively connected to a mechanically activated control.
FIG. 2 is an exploded diagrammatic perspective view of the rotary indexing mechanism of the embodiments of the present invention operatively connected to a mechanically activated control as shown in FIG. 1.
FIG. 4 is an enlarged diagrammatic fragmented elevational view of the area generally enclosed by the dotted circle identified by ARROW 4 in FIG. 2.
Figure 8:
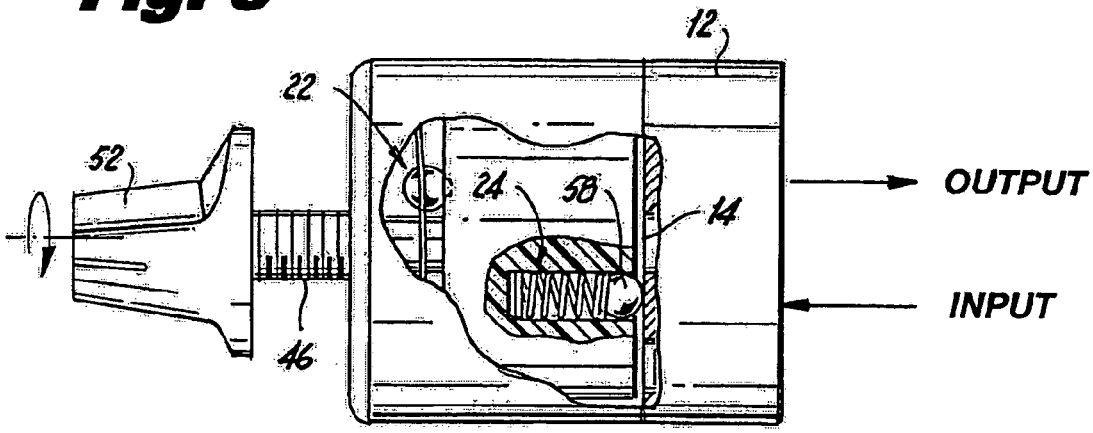
Figure 9:
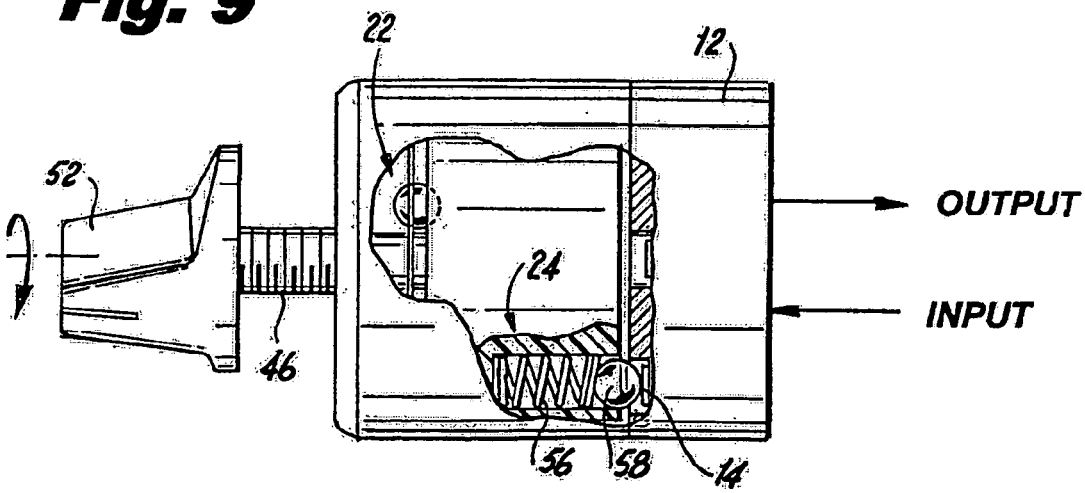

FIG. 8 is an enlarged diagrammatic side elevational view in partial section of the rotary indexing mechanism of the embodiments of the present invention operatively connected to a mechanically activated control identified by ARROW 8 in FIG. 1 and depressing no button switches of the mechanically activated control; and FIG. 9 is an enlarged diagrammatic side elevational view in partial section of the rotary indexing mechanism of the embodiments of the present invention operatively connected to a mechanically activated control identified by ARROW 9 in FIG. 1 and depressing another button switch of the mechanically activated control.

4. LIST OF REFERENCE NUMERALS UTILIZED IN THE DRAWING

A. General

10 rotary indexing mechanism of embodiments of present invention for mechanically activated control 12
12 mechanically activated control
14 button switches contained in mechanically activated control 12
16 input of mechanically activated control 12
18 output of mechanically activated control 12
19 frame of mechanically activated control 12

B. Overall Configuration of Rotary Indexing Mechanism 10

20 insulator for rotatably attaching to mechanically activated control 12 by frame 19 of mechanically activated control 12
22 input assembly
24 output assembly for activating mechanically activated control 12
26 forward-facing surface of insulator 20
28 rearward-facing surface of insulator 20

C. Specific Configuration of Input Assembly 22

30 through slot through insulator 20 of input assembly 22
32 annular groove in forward-facing surface 26 of insulator 20 of input assembly 22
34 plurality of generally hemispherical detents in forward-facing surface 26 of insulator 20 of input assembly 22
36 plurality of balls of input assembly 22
38 resilient spring plate of input assembly 22 for attaching to frame 19 of mechanically activated control 12
40 plurality of through bores through resilient spring plate 38 of input assembly 22
42 housing of input assembly 22 for attaching to and partially encapsulating mechanically activated control 12
44 through bore through housing of input assembly 22
46 shaft of input assembly 22
48 exposed end of shaft 46 of input assembly 22
50 flat of shaft 46 of input assembly 22
52 knob of input assembly 22

D. Specific Configuration of Output Assembly 24

54 blind bore in rearward-facing surface 28 of insulator 20 of output assembly 24
56 coil spring of output assembly 24
58 ball of output assembly 24 for selectively depressing button switch 14 of mechanically activated control 12

5. DETAILED DESCRIPTION OF THE PREFERRED EMBODIMENTS

A. General

Referring now to the figures, in which like numerals indicate like parts, and particularly to FIG. 1, which is a diagrammatic perspective view of the rotary indexing mechanism of the embodiments of the present invention operatively connected to a mechanically activated control, the rotary indexing mechanism of the embodiments of the present invention is shown generally at 10 for a mechanically activated control 12. The mechanically activated control 12 is of a type that is, but is not limited to, hydraulic, electrical, fiber optics, etc., contains button switches 14, and has an input 16, an output 18, and a frame 19.

B. The Overall Configuration of the Rotary Indexing Mechanism 10

The overall configuration of the rotary indexing mechanism 10 can best be seen in FIG. 2, which is an exploded diagrammatic perspective view of the rotary indexing mechanism of the embodiments of the present invention operatively connected to a mechanically activated control as shown in FIG. 1, and as such, will be discussed with reference thereto.

The rotary indexing mechanism 10 comprises an insulator 20, an input assembly 22, and an output assembly 24. The insulator 20 is for rotatably attaching to the mechanically activated control 12 by way of the frame 19 of the mechanically activated control 12. The input assembly 22 is operatively connected to the insulator 20 and selectively rotates the insulator 20. The output assembly 24 is operatively connected to the insulator 20 and is for selectively activating the mechanically activated control 12.

The insulator 20 is generally cylindrically shaped and has a forward-facing surface 26 and a rearward-facing surface 28.

C. The Specific Configuration of the Input Assembly 22

Figure 3:
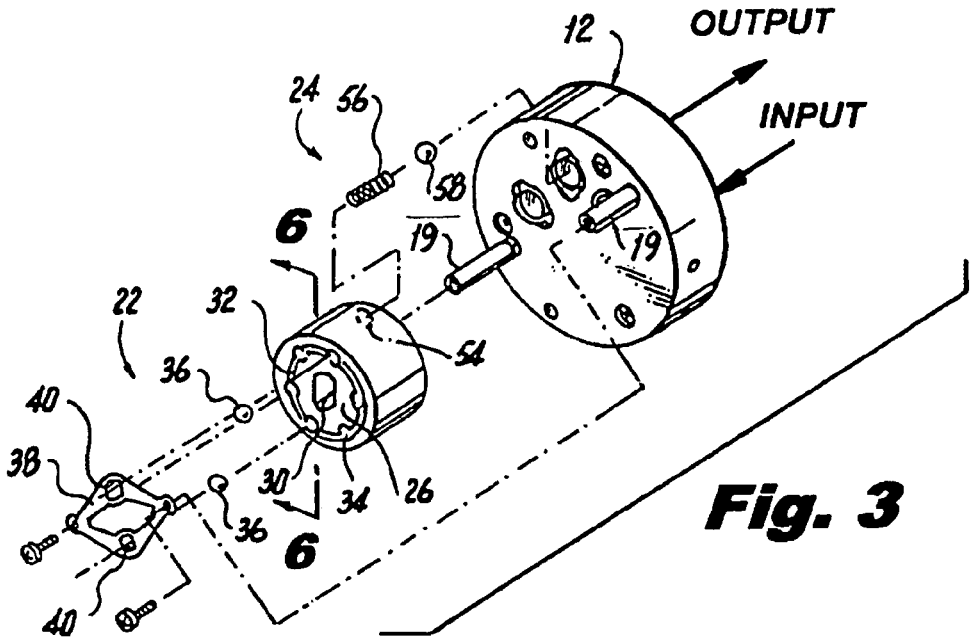
FIG. 3 is an exploded diagrammatic perspective view of a portion of the rotary indexing mechanism of the embodiments of the present invention operatively connected to a mechanically activated control identified by ARROW 3 in FIG. 2.
Figure 5:
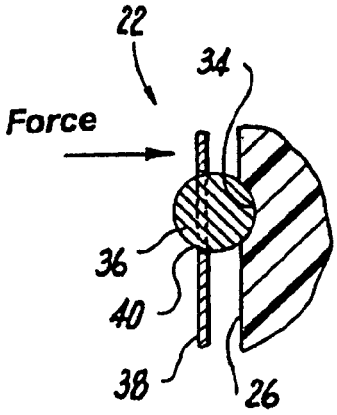
FIG. 5 is an enlarged diagrammatic cross sectional view taken along LINE 5-5 in FIG. 4.
Figure 6:
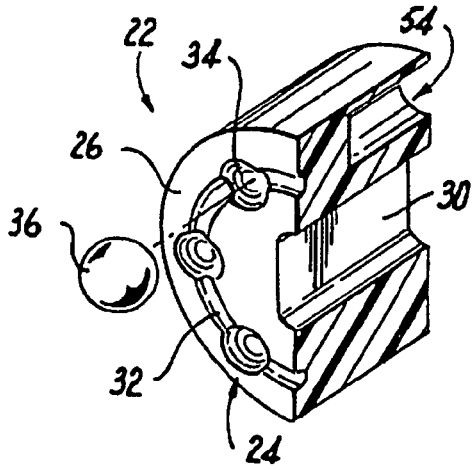
FIG. 6 is an enlarged diagrammatic cross sectional view taken along LINE 6-6 in FIG. 3.

The specific configuration of the input assembly 22 can best be seen in FIGS. 2-6, which are, respectively, again an exploded diagrammatic perspective view of the rotary indexing mechanism of the embodiments of the present invention operatively connected to a mechanically activated control as shown in FIG. 1, an exploded diagrammatic perspective view of a portion of the rotary indexing mechanism of the embodiments of the present invention operatively connected to a mechanically activated control identified by ARROW 3 in FIG. 2, an enlarged diagrammatic fragmented elevational view of the area generally enclosed by the dotted circle identified by ARROW 4 in FIG. 2, an enlarged diagrammatic cross sectional view taken along LINE 5-5 in FIG. 4, and an enlarged diagrammatic cross sectional view taken along LINE 6-6 in FIG. 3, and as such, will be discussed with reference thereto.

The input assembly 22 comprises the insulator 20 having a through slot 30. The through slot 30 through the insulator 20 of the input assembly 22 extends centrally therethrough.

The input assembly 22 further comprises the forward-facing surface 26 of the insulator 20 having an annular groove 32. The annular groove 32 in the forward-facing surface 26 of the insulator 20 of the input assembly 22 extends annually therearound.

The input assembly 22 further comprises the forward-facing surface 26 of the insulator 20 having a plurality of generally hemispherical detents 34. The plurality of generally hemispherical detents 34 in the forward-facing surface 26 of the insulator 20 of the input assembly 22 depend in the annular groove 32 in the forward-facing surface 26 of the insulator 20 of the input assembly 22, are equal in number, and are equally spaced-apart from each other.

The input assembly 22 further comprises a plurality of balls 36. The plurality of balls 36 of the input assembly 22 are equal in number, ride in the annular groove 32 in the forward-facing surface 26 of the insulator 20 of the input assembly 22, and selectively engage in an equal number of the plurality of generally hemispherical detents 34 in the forward-facing surface 26 of the insulator 20 of the input assembly 22.

The input assembly 22 further comprises a resilient spring plate 38. The resilient spring plate 38 of the input assembly 22 is for attaching to the frame 19 of the mechanically activated control 12, surrounds the through slot 30 through the insulator 20, and maintains and biases the plurality of balls 36 of the input assembly 22 in the annular groove 32 in the forward-facing surface 26 of the insulator 20 of the input assembly 22 and in the plurality of generally hemispherical detents 34 in the forward-facing surface 26 of the insulator 20 of the input assembly 22.

The resilient spring plate 38 of the input assembly 22 has a plurality of through bores 40. The plurality of through bores 40 through the resilient spring plate 38 of the input assembly 22 are equal in number, oppose each other, and receive the plurality of balls 36 of the input assembly 22, respectively, to maintain and bias the plurality of balls 36 of the input assembly 22 in the annular groove 32 in the forward-facing surface 26 of the insulator 20 of the input assembly 22 and in the plurality of generally hemispherical detents 34 in the forward-facing surface 26 of the insulator 20 of the input assembly 22.

The input assembly 22 further comprises a housing 42. The housing 42 of the input assembly 22 encapsulates the insulator 20, has a through bore 44, and is for attaching to and partially encapsulating the mechanically activated control 12.

The input assembly 22 further comprises a shaft 46. The shaft 46 of the input assembly 22 has an exposed end 48 and extends rotatably through the through bore 44 through the housing 42 of the input assembly 22 and into the through bore 30 in the insulator 20 and is fixed therein by virtue of the shaft 46 of the input assembly 22 having a flat 50 cooperating with the through bore 44 through the housing 42 of the input assembly 22 so as to allow the insulator 20 to rotate when the shaft 46 of the input assembly 22 selectively rotates.

The input assembly 22 further comprises a knob 52. The knob 52 of the input assembly 22 is affixed to the exposed end 48 of the shaft 46 of the input assembly 22 to rotate therewith.

D. The Specific Configuration of the Output Assembly 24

The specific configuration of the output assembly 24 can best be seen in FIG. 3, which is again an exploded diagrammatic perspective view of a portion of the rotary indexing mechanism of the embodiments of the present invention operatively connected to a mechanically activated control identified by ARROW 3 in FIG. 2, and as such, will be discussed with reference thereto.

The output assembly 24 comprises the rearward-facing surface 28 of the insulator 20 having a blind bore 54. The blind bore 54 in the rearward-facing surface 28 of the insulator 20 of the output assembly 24 extends therein at a radius substantially equal to that of the annular groove 32 in the forward-facing surface 26 of the insulator 20 of the input assembly 22.

The output assembly 24 further comprises a coil spring 56. The coil spring 56 of the output assembly 24 sits in the blind bore 54 in the rearward-facing surface 28 of the insulator 20 of the output assembly 24.

The output assembly 24 further comprises a ball 58. The ball 58 of the output assembly 24 sits partially in the blind bore 54 in the rearward-facing surface 28 of the insulator 20 of the output assembly 24, is biased outwardly therefrom by the coil spring 56 of the output assembly 24, and is for selectively depressing a button switch 14 of the mechanically activated control 12.

E. The Method of Using the Rotary Indexing Mechanism 10 for the Mechanically Activated Control 12

Figure 7:
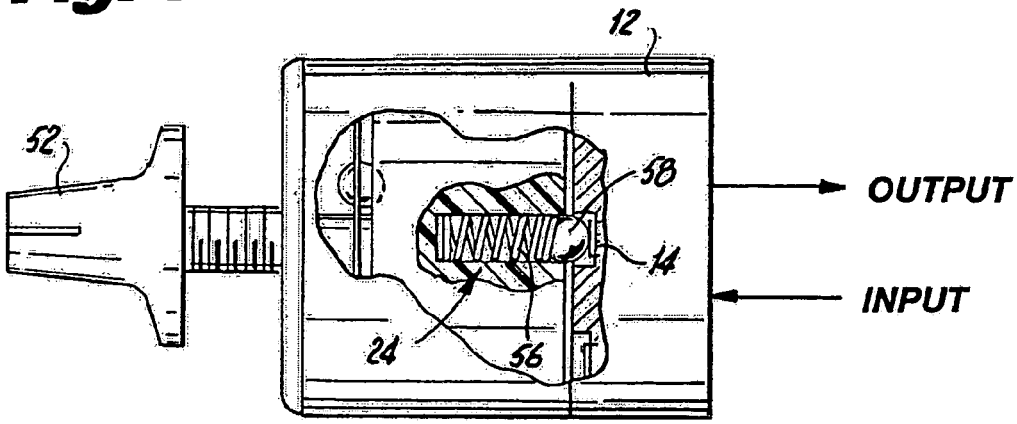
FIG. 7 is an enlarged diagrammatic side elevational view in partial section of the rotary indexing mechanism of the embodiments of the present invention operatively connected to a mechanically activated control identified by ARROW 7 in FIG. 1 and depressing one button switch of the mechanically activated control.

The method of using the rotary indexing mechanism 10 for the mechanically activated control 12 can best be seen in FIGS. 7-9, which are, respectively, an enlarged diagrammatic side elevational view in partial section of the rotary indexing mechanism of the embodiments of the present invention operatively connected to a mechanically activated control identified by ARROW 7 in FIG. 1 and depressing one button switch of the mechanically activated control, an enlarged diagrammatic side elevational view in partial section of the rotary indexing mechanism of the embodiments of the present invention operatively connected to a mechanically activated control identified by ARROW 8 in FIG. 1 and depressing no button switches of the mechanically activated control, and an enlarged diagrammatic side elevational view in partial section of the rotary indexing mechanism of the embodiments of the present invention operatively connected to a mechanically activated control identified by ARROW 9 in FIG. 1 and depressing another button switch of the mechanically activated control, and as such, will be discussed with reference thereto.

As shown in FIG. 7, the ball 58 of the output assembly 24, biased by the coil spring 56 of the output assembly 24, depresses one button switch 14 of the mechanically activated control 12.

As shown in FIG. 8, the shaft 46 of the input assembly 22 is rotated, via the knob 52 of the input assembly 22, to release the ball 58 of the output assembly 24 from the depressed one button switch 14 of the mechanically activated control 12 thereby undepressing the one button switch 14 of the mechanically activated control 12.

As shown in FIG. 9, the shaft 46 of the input assembly 22 is further rotated, via the knob 52 of the input assembly 22, causing the ball 58 of the output assembly 24, biased by the coil spring 56 of the output assembly 24, to depress another button switch 14 of the mechanically activated control 12.

F. The Conclusions

It will be understood that each of the elements described above or two or more together may also find a useful application in other types of constructions differing from the types described above.

While the embodiments of the present invention has been illustrated and described as embodied in a rotary indexing mechanism for a mechanically activated control, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt it for various applications without omitting features that from the standpoint of prior art fairly constitute characteristics of the generic or specific aspects of the embodiments of the present invention.

The invention claimed is:

1. A rotary indexing mechanism for a mechanically activated control, wherein the mechanically activated control contains button switches, and has an input, an output, and a frame, said mechanism comprising:

a) an insulator;

b) an input assembly; and c) an output assembly;

wherein said insulator is for rotatably attaching to the mechanically activated control by way of the frame of the mechanically activated control;

wherein said input assembly is operatively connected to said insulator;

wherein said input assembly selectively rotates said insulator;

wherein said output assembly is operatively connected to said insulator; and wherein said output assembly is for selectively activating the mechanically activated control.

2. The mechanism of claim 1, wherein said insulator is generally cylindrically shaped;

wherein said insulator has a forward-facing surface; and wherein said insulator has a rearward-facing surface.

3. The mechanism of claim 2, wherein said input assembly comprises said insulator having a through slot; and wherein said through slot through said insulator of said input assembly extends centrally therethrough.

4. The mechanism of claim 3, wherein said input assembly comprises said forward-facing surface of said insulator having an annular groove; and wherein said annular groove in said forward-facing surface of said insulator of said input assembly extends annually therearound.

5. The mechanism of claim 4, wherein said input assembly comprises said forward-facing surface of said insulator having a plurality of generally hemispherical detents;

wherein said plurality of generally hemispherical detents in said forward-facing surface of said insulator of said input assembly depend in said annular groove in said forward-facing surface of said insulator of said input assembly;

wherein said plurality of generally hemispherical detents in said forward-facing surface of said insulator of said input assembly are equal in number; and wherein said plurality of generally hemispherical detents in said forward-facing surface of said insulator of said input assembly are equally spaced-apart from each other.

6. The mechanism of claim 5, wherein said input assembly comprises a plurality of balls;

wherein said plurality of balls of said input assembly are equal in number;

wherein said plurality of balls of said input assembly ride in said annular groove in said forward-facing surface of said insulator of said input assembly; and wherein said plurality of balls of said input assembly selectively engage in an equal number of said plurality of generally hemispherical detents in said forward-facing surface of said insulator of said input assembly.

7. The mechanism of claim 6, wherein said input assembly comprises a resilient spring plate;

wherein said resilient spring plate of said input assembly is for attaching to the frame of the mechanically activated control;

wherein said resilient spring plate of said input assembly surrounds said through slot through said insulator;

wherein said resilient spring plate of said input assembly maintains and biases said plurality of balls of said input assembly in said annular groove in said forward-facing surface of said insulator of said input assembly; and wherein said resilient spring plate of said input assembly maintains said plurality of balls of said input assembly in said plurality of generally hemispherical detents in said forward-facing surface of said insulator of said input assembly.

8. The mechanism of claim 7, wherein said resilient spring plate of said input assembly has a plurality of through bores;

wherein said plurality of through bores through said resilient spring plate of said input assembly are equal in number;

wherein said plurality of through bores through said resilient spring plate of said input assembly oppose each other; and wherein said plurality of through bores through said resilient spring plate of said input assembly receive said plurality of balls of said input assembly, respectively, to maintain and bias said plurality of balls of said input assembly in said annular groove in said forward-facing surface of said insulator of said input assembly and in said plurality of generally hemispherical detents in said forward-facing surface of said insulator of said input assembly.

9. The mechanism of claim 4, wherein said output assembly comprises said rearward-facing surface of said insulator having a blind bore; and wherein said blind bore in said rearward-facing surface of said insulator of said output assembly extends therein at a radius substantially equal to that of said annular groove in said forward-facing surface of said insulator of said input assembly.

10. The mechanism of claim 9, wherein said output assembly comprises a coil spring; and wherein said coil spring of said output assembly sits in said blind bore in said rearward-facing surface of said insulator of said output assembly.

11. The mechanism of claim 10, wherein said output assembly comprises a ball;

wherein said ball of said output assembly sits partially in said blind bore in said rearward-facing surface of said insulator of said output assembly;

wherein said ball of said output assembly is biased outwardly therefrom by said coil spring of said output assembly; and wherein said ball of said output assembly is for selectively depressing a button switch of the mechanically activated control.

12. The mechanism of claim 1, wherein said input assembly comprises a housing;

wherein said housing of said input assembly encapsulates said insulator;

wherein said housing of said input assembly has a through bore; and wherein said housing of said input assembly is for attaching to and partially encapsulating the mechanically activated control.

13. The mechanism of claim 12, wherein said input assembly comprises a shaft;

wherein said shaft of said input assembly has an exposed end;

wherein said shaft of said input assembly extends rotatably through said through bore through said housing of said input assembly and into said through bore in said insulator; and wherein said shaft of said input assembly is fixed in said through bore in said insulator by virtue of said shaft of said input assembly having a flat cooperating with said through bore through said housing of said input assembly so as to allow said insulator to rotate when said shaft of said input assembly selectively rotates.

14. The mechanism of claim 13, wherein said input assembly comprises a knob; and wherein said knob of said input assembly is affixed to said exposed end of said shaft of said input assembly to rotate therewith.

* * * * *